US006161245A

United States Patent [19]

Weihrauch

[11] Patent Number: 6,161,245

[45] Date of Patent: Dec. 19, 2000

[54] BRUSH-WARE WITH ADJUSTABLE BRISTLE HARDNESS

[75] Inventor: Georg Weihrauch, Wald-Michelbach, Germany

[73] Assignee: Coronet-Werke GmbH, Wald-Michelbach, Germany

[21] Appl. No.: 09/051,722

[22] PCT Filed: Oct. 3, 1996

[86] PCT No.: PCT/EP96/04306

§ 371 Date: Jul. 23, 1998

§ 102(e) Date: Jul. 23, 1998

[87] PCT Pub. No.: WO97/14330

PCT Pub. Date: Apr. 24, 1997

[30] Foreign Application Priority Data

Oct. 17, 1995 [DE] Germany ..... 195 38 569

[51] Int. Cl.[7] ..... A46B 9/08; A46B 9/10

[52] U.S. Cl. ..... 15/201; 15/167.1

[58] Field of Search ..... 15/201, 203, 190, 15/191.1, 172, 167.1, 185, 186, 188, 202

[56] References Cited

U.S. PATENT DOCUMENTS

| | | | |
|---|---|---|---|
| 2,882,544 | 4/1959 | Hadidian | 15/201 |
| 3,065,757 | 11/1962 | Peilet | 15/201 |
| 3,082,457 | 3/1963 | Lucibello et al. | 15/167.1 |

FOREIGN PATENT DOCUMENTS

| | | | |
|---|---|---|---|
| 808892 | 2/1937 | France . | |
| 1060128 | 3/1954 | France . | |
| 96839 | 9/1898 | Germany | 15/201 |
| 2114533 | 6/1972 | Germany . | |
| 2721352 | 11/1978 | Germany | 15/167.1 |
| 1680047 | 9/1991 | Russian Federation | 15/191.1 |

*Primary Examiner*—Gary K. Graham

*Attorney, Agent, or Firm*—Antonelli, Terry, Stout & Kraus, LLP

[57] ABSTRACT

The brushware comprises a bristle carrier and bristles fixed thereto, which are either arranged singly or in bundles and whose hardness is adjustable. A particularly simple, space-saving and hygienically satisfactory setting of the bristle hardness is obtained in that the bristles are elastically mounted on the bristle carrier and in the case of force action are deflectable at least tranversely to their axis and that the deflection angle of the bristles is adjustable.

28 Claims, 6 Drawing Sheets

BRUSH-WARE WITH ADJUSTABLE BRISTLE HARDNESS

TECHNICAL FIELD

The invention relates to brushware comprising a bristle carrier and bristles fixed thereto, which are either arranged singly or in bundles and whose hardness is adjustable.

BACKGROUND AND SUMMARY

In the sense of the present invention brushware is understood to mean all products which are equipped with bristles or bristle bundles. These include in particular brushes of all types, no matter whether they are manually or mechanically operated, tools provided with bristles or components provided with bristles which are supplemented to form tools, as well as paintbrushes of all types.

The hardness of a bristle is essentially determined by its length and cross-section, as well as by the material choice. The choice of bristle hardness is in turn determined by the intended use of the brushware or the in each case desired function. In the case of brushes for cleaning dirty surfaces, as well as for technical functions, the scratching and brushing action is vital, i.e. the bristles must be correspondingly hard or coarse. In the case of brushes for polishing purposes, light cleaning work, etc., a more rubbing action is desired, which requires softer or finer bristles. The same applies with respect to paintbrushes and particularly in the latter connection a wide graduation is desired. This is not only implemented by the characteristics of the individual bristle, but also by the way in which the bristles are formed into bundles. The same applies for brushes in the hygienic sector, e.g. tooth, cosmetic, body and massaging brushes. In the case of toothbrushes three degrees of hardness have proved necessary, i.e. coarse, medium and fine, in order to meet the individual requirements of the user.

So that in the case of a brush having a specific intended use, an individual brush is not necessary for each degree of hardness, brushes with variable bristle hardnesses are known. This takes place in all the known constructions exclusively by modifying the free length of the bristles, i.e. the bristle bending length acting under force action. It is known (DE 2 114 533) to draw a perforated plate over the bristles fixed to the bristle carrier and the spacing thereof from the bristle carrier can be adjusted by a control or adjusting device. The essential bending length of the bristles is then determined by their length projecting over the perforated plate and can be continuously and individually adjusted.

In another known construction (U.S. Pat. No. 1,189,698) the bristle carrier is hollow and the bristle bundles are located in inclined manner in said cavity and are fixed to a slide. The bundles pass through a bristle carrier wall provided with holes and by means of the slide can be slid out or drawn in to different lengths.

These known constructions, which have only proved partly satisfactory in practice, give rise to problems especially in the hygienic sector. As the bristle bundles are movable relative to the holes in which they are guided, corresponding guide gaps must be provided. Dirt and care agents are deposited in the said gaps and also form hygienically unacceptable bacteria accumulations. As a result of hardening care agents, such as dental care agents and the like, encrustations occur, which finally lead to unserviceability. It is also disadvantageous that the bristle or bristle bundles must have a length permitting the adjustment of the greatest free bending length, i.e. a very soft setting, although the user may only wish for a medium or hard setting. This also presupposes a corresponding overall height of the bristle carrier with its guidance and control device. With numerous brushes, such as toothbrushes, cosmetic brushes, etc., a particularly small overall height is desired.

The known systems with variable bristle length have consequently only individually proved successful in practice, particularly in the case of massaging brushes (DE 2 114 533). This technology has not been used in practice for toothbrushes, so that an individual toothbrush is always offered for each degree of hardness. Quite apart from the fact that generally only three hardness grades are offered i.e. coarse, medium and fine, said graduation is inadequate for many purposes and in particular it does not allow any individual adaptation on the part of the user, because e.g. dental necks and gums may temporarily have different sensitivities in the same person.

The problem of the invention, in the case of brushware of a random nature with adjustable bristle hardness, is to give the user a possibility of individually adapting the bristle hardness to his needs, without dirt and the like giving rise to hygienic problems, whilst at the same time a small overall height is sought.

This problem is inventively solved in the case of brushware, whose bristles have an adjustable hardness, in that the bristles are elastically mounted on the bristle carrier and in the case of force application are deflectable at least transversely to the axis thereof, the bristle deflection angle being adjustable.

In the brushware construction according to the invention, the hardness of the individual bristle or the bundle formed from several bristles is not only determined by the geometrical dimensions thereof (length and cross-section) and the material from which they are made, but is also influenced by the elastic mounting, which makes it possible for the bristle or bundle, in the case of force action on the bristles to be deflected transversely to the axis and then to become upright again when the force is removed. Thus, the bending or re-righting capacity of the bristle results from the combined action of physical characteristics of the bristle on the one hand and the elastic behaviour of the bristle bearing or support on the other. Therefore the bristle hardness can be varied within wide limits. Unlike in the prior art, the hardness is not changed by a modification of the bristle length and the resulting necessary guidance of the bristles, but only by measures in the vicinity of the bristle foot or base. There are no movable guide parts in the vicinity of the free length of the bristles with all their disadvantages, such as dirt, encrustation, lack of cleaning possibility, additional hard parts in the vicinity of the bristles, etc. With such brushware, there is no need to take the precaution on the bristle carrier that the adjustable length is absorbed within said carrier and instead the bristles within the carrier can be made relatively short.

The elastic mounting or bearing can be so constructed that a deflection is only possible transversely to the bristle axis. In the case of a reciprocating movement, the bristles only deflect in one movement direction, i.e. act in said direction as soft bristles, whereas they are rendered upright in the other direction and act as hard bristles. Different effects can be attained in both movement directions, e.g. more scratching and brushing in one and more sweeping and rubbing in the other. As a result of a deflectability in all directions a type of unstable mounting with a corresponding degree of hardness in all directions is obtained. The elastic mounting can also be constructed in such a way that a damping action occurs in the axial direction of the bristles.

In a preferred construction the bristles are located in an elastic bearing or support in a bristle carrier and can be deflected accompanied by the deformation of the bearing or support. Preferably, on the bristle carrier is located an adjusting or control device acting on the elastic bearing permitting the adjustment of the extent of the deformation of the elastic bearing and therefore the deflection of the bristles.

Thus, the control device advantageously has means for limiting the deformation of the elastic bearing. In a position influenced by the control device bristle deflection is at a maximum. The control device can then be so adjusted that in the other extreme position the bearing elasticity is virtually completely eliminated.

A preferred construction of the control device has at least one rigid bearing associated with the elastic bearing and which is spaced from the latter and can be fed up to the latter by means of the control device. Therefore the rigid bearing acts as a type of adjustable abutment for the elastic bearing of the bristles. The control path is relatively short, because it is merely necessary to bridge a distance between the complete release of the elastic bearing by means of an increasing limitation of the elasticity to its approximately complete elimination.

According to another preferred embodiment the bristles are fixed with the elastic bearing in the holes of a rigid perforated plate, whose front side forms the use-side surface of the bristle carrier and project over the back of the perforated plate. The control device engages with the rigid bearing on the elastic bearing areas projecting over the perforated plate.

Unlike in the prior art, the perforated plate is a fixed part of the bristle carrier and the holes are closed by the elastic bearings and the receiving bristles, so that there are no gaps for the deposition and fixing of dirt, care agents, etc. The brushware has the same external appearance as a brushware without adjustable bristle hardness.

A first embodiment is characterized in that the control device has a control plate substantially parallel to the perforated plate in the bristle carrier and which on its side facing the perforated plate has the rigid bearing associated with the elastic bearing.

The control plate is guided in the bristle carrier and from a position in which the distance between the rigid and elastic bearings is at a maximum, can be fed up to the perforated plate whilst reducing said distance, the deformation capacity of the elastic bearing being increasingly limited by the rigid bearing. In the opposite movement direction the elastic bearings are increasingly freed and can therefore correspondingly deform in the case of force action on the bristles.

The control plate can also be constructed as transversely displaceable slide, but preferably there are at least two oppositely guided slides parallel to the perforated plate on the bristle carrier and which have in each case two facing portions of the rigid bearing with respect to the bearing axis.

In this construction the rigid bearing is at least in two parts and preferably in the axis of the bristle or bristle bundle and in each case one bearing part is located on one of the two slides. By opposing movement of the slides, the distance between the bearing parts can be increasingly reduced from a maximum spacing position and in this way the elasticity of said bearing is increasingly reduced.

Preferably the elastic bearings are constituted by pins or sleeves, which are circumferentially held in the holes of the perforated plate and in which are anchored by their fastening-side end the bristles.

Appropriately the rigid bearings are constructed on the control device as bearing bushes, which widen in the direction of the elastic bearings and correspond with their terminal outer contour. From the maximum bristle hardness position, in which the rigid bearings completely engage round the terminal outer contour of the elastic bearings and almost completely eliminate the elasticity thereof, on moving away by means of the control device, the bearing bushes give the elastic bearings an increasingly larger clearance for deformation purposes.

Instead of this, it can also be provided that the pins or sleeves forming the elastic bearings have a depression in their face facing the control device and in which engages a projection of the control device forming the rigid bearing.

It is also advantageous in this embodiment, if the projection and depression have congruent contours and namely preferably conically widening or conically tapering.

In the simplest construction the rigid bearing is formed by a planar abutment in the form of a plate, which is parallel to the perforated plate and cooperates with the terminal, planar face of the pin or sleeve.

In this construction action only takes place on the free face of the elastic bearing. In the case of complete engagement of the plate abutment or abutment plate, the elastic bearing is almost completely blocked. Even with a minimum spacing of the abutment plate, the sleeve or pin can deform transversely to its axis and tilt its face to such an extent that it comes into contact with the abutment plate and consequently bristle deflection is possible and the bristle hardness is set to a lower level.

In another preferred construction, the bristles are melted at their fastening-side end to a thickening with which they are anchored in the elastic bearing.

As a result of this per se known fastening procedure, it is ensured that the bristles, despite the elasticity of the bearing receiving them, are firmly anchored over the entire adjustment range of the deflecting means.

If the thickening of the bristles is in the elastic bearing area projecting over the perforated plate, there is a maximum deflection and consequently a wider adjustment range for the bristle hardness. If, however, only a smaller adjustment range is necessary, the thickening can be located within the holes of the perforated plate and essentially only the elasticity in the vicinity of the sleeve located in the perforated plate and the terminal face projecting over the perforated plate and on which the rigid bearing acts is used.

Another preferred embodiment is characterized in that the perforated plate is fixed with the elastic bearings fixed thereon and the bristles in interchangeable manner to the bristle carrier.

Brushware with interchangeable bristle heads are known. However, this is only intended to deal with the ecological problem of waste elimination and the necessary recycling of plastics. This objective can be eminently combined with the inventive solution in that the perforated plate with the elastic bearings and the bristles received by the same is locked on the bristle carrier and can be ejected by means of the control device. Thus, the control device here fulfils two functions, on the one hand the setting of the bristle hardness and on the other the replacement of the bristle facing.

For housing the control device, in the vicinity of the bristle facing the bristle carrier has a recess, in which the control device is guided and which is closed by the perforated plate.

The operation of the control device can be carried out in different ways. For example, the control device can have a screw cooperating with the control plate, which is mounted on the bristle carrier and is equipped with an accessible knob on the back of the bristle carrier.

By operating the knob by means of the thread of the screw the control plate is fed to a greater or lesser extent up to the elastic bearing and, as stated, the control path need only be very small.

In order to link the function of setting the bristle hardness with the replacement of the bristle facing, the aforementioned embodiment is further characterized by a resilient construction of the bristle carrier in the vicinity of the screw mounting and said area is deformable by pressure on the knob for the ejection of the perforated plate.

By turning the knob it is possible to adjust the control plate and consequently the bristle hardness, whereas by pressure on the knob the perforated plate is released from the locking means and ejected.

If the control device has opposing slides, they are preferably operable by means of accessible tongues on the bristle carrier. However, it is also possible to use for knob operation eccentrics or other actuating means, which allow such an opposing movement.

Preferably the pins or sleeves forming the elastic bearings are made from an elastomer with rubber-elastic properties. They can be manufactured together with the perforated plate in the multicomponent injection moulding process, accompanied by the simultaneous embedding of the fastening-side thickenings of the bristles.

Thus, the brushware according to the invention only comprises a few parts, namely the bristle carrier, the perforated plate with the bristles anchored therein, the control device and its actuating means.

In an ideal manner, the invention provides the possibility of having on a single brush bristles or bristle bundles of different hardness levels, in that e.g. individual bundles or bristles are completely injected into the perforated plate material, whereas another part of the bristle facing is located in the elastic bearings constructed according to the invention. Whereas the former bristles or bristle bundles have a bending behaviour exclusively determined by the free length and cross-section thereof, the latter bristles have an additional elasticity. The deflection of the elastically mounted bristles can be made to differ by corresponding geometrical design of the elastic bearings.

BRIEF DESCRIPTION OF THE DRAWINGS

The invention is described in greater detail hereinafter relative to embodiments and the attached drawings, wherein show.

DETAILED DESCRIPTION

Figure 1:
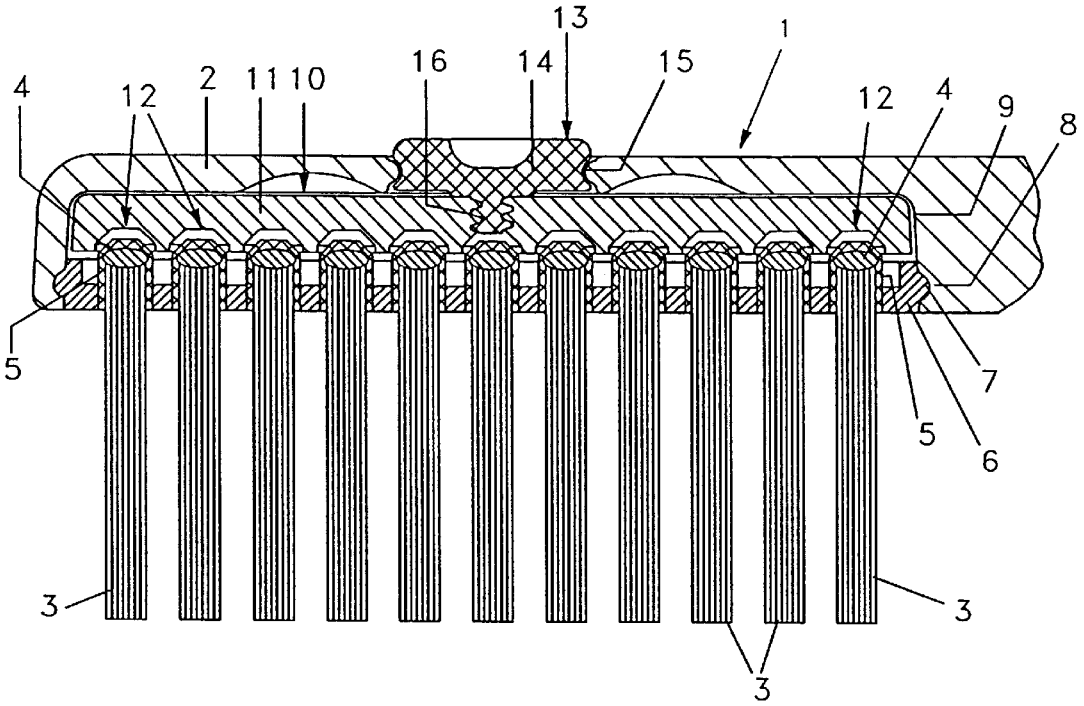
FIG. 1 A partial section through a toothbrush.

FIG. 1 shows in exemplified manner a toothbrush head 1, but the subsequently described head construction can be transferred to random other brushware.

The toothbrush head 1 forms a bristle carrier 2 for receiving the bristles combined into bundles 3. The fastening-side ends of the bristle bundles 3 have head-like thickenings 4, which are obtained by melting the bristle ends. By means of said head-like thickenings 4, the fastening-side ends of the bundles 3 are located in elastic bearings 5, which are in turn fixed in the holes of a perforated plate 6 and project over the back thereof. The thickenings 4 of the bristle bundles 3 are located in the elastic bearing area projecting over the perforated plate. The front of the perforated plate forms the use-side surface of the bristle carrier.

In the embodiment shown the perforated plate 6 is provided with a circumferential rib 7, which is locked in a circumferential channel 8 in the wall of a recess 9 of the bristle carrier 2. The recess 9 also houses a control or adjusting device 10, which in the embodiment according to FIG. 1 is constructed as an adjusting or control plate 11 and has on its surface facing the bristles widening, shell-shaped depressions, which as rigid bearings 12 cooperate with the elastic bearings 5. The control device 10 also has an actuating means 13 in the form of a knob 14, which is mounted in rotary manner at 15 in the bristle carrier 2 and has a screw 16, with which it engages in a corresponding internal thread on the control plate 11. By turning the knob 14, it is consequently possible to feed the control plate 11 within the recess 9 in the direction of the elastic bearings 5.

Figure 2:
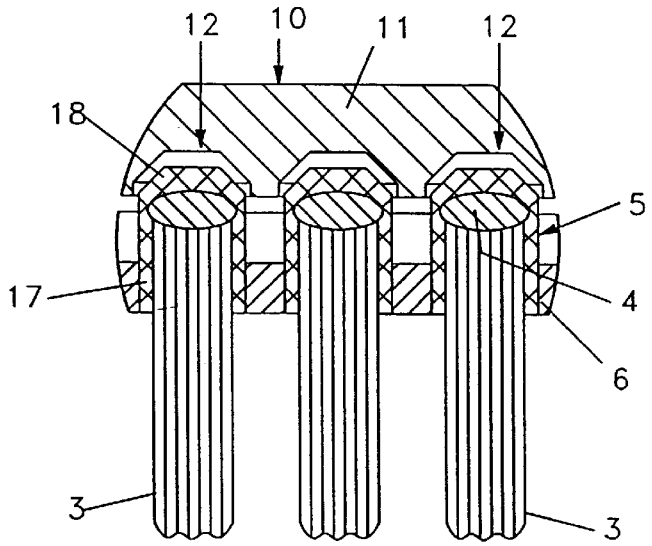
FIG. 2 A larger scale detail of FIG. 1.

FIG. 2 shows on a larger scale three bristle bundles 3 with their elastic bearings 5. The elastic bearings 5, which are preferably made from an elastomer, are constructed as sleeves, which at their one face terminate flush with the perforated plate 6, whereas on the other face they are closed by a base 18. The bristle bundle 3 with the terminal thickening 4 is firmly anchored in the elastic bearing 5. The sleeve 17 is firmly seated in the perforated plate 6. The rigid abutments 12 on the control plate 11 have a shell-shaped construction, their contour corresponding to the contour of the sleeve 17 in the vicinity of the base 18.

Figure 3:
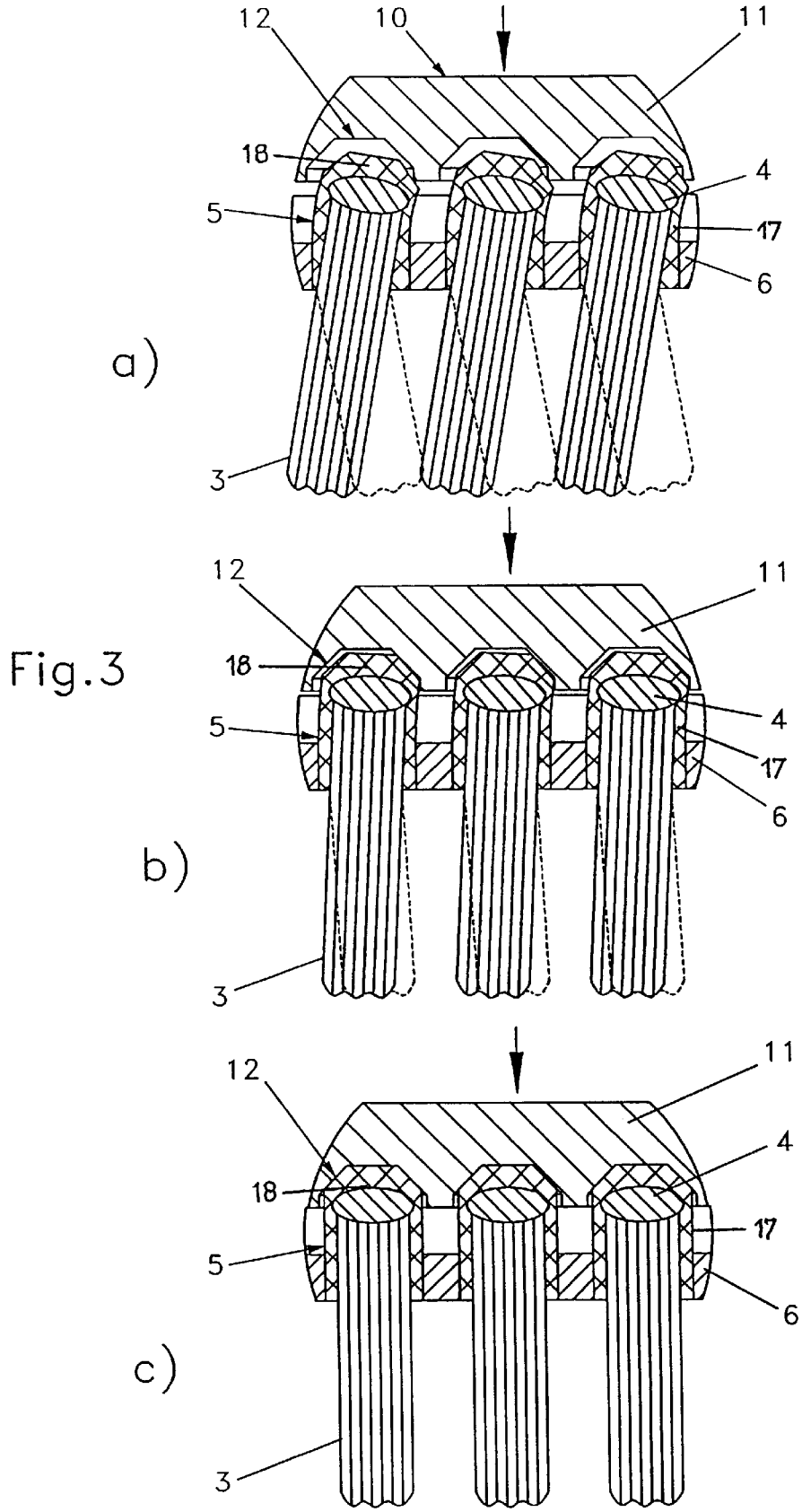
FIG. 3 Different operating positions a, b and c of the control device for bristle hardness adjustment.

FIG. 3 shows different operating positions of the control plate 11. In position a) the control plate 11 or its rigid bearing 12 has the greatest distance from the elastic bearings 5. In this position the bundles 3 can be deflected in the case of force action between the position shown in continuous line form and that shown in broken line form. In this position the areas of the elastic bearings 5 projecting inwards over the perforated plate 6 can be deformed to the greatest extent, as indicated at a) in FIG. 3. They are not prevented from deforming by the rigid bearings on the control plate 11. By feeding the control plate 11 into the position b), the deformability of the elastic bearings 5 is restricted, in that when force is exerted on the bristle bundles 3 the elastic deformation of the bearings 5 is limited by the rigid bearings 12. The elastic bearings engage on the corresponding abutment faces of the rigid bearings 12. The bundles can only be deflected With a smaller angle, as indicated in FIG. 3*b*. If the control plate 11 is finally brought into its other end position c), then the rigid bearings 12 completely embrace the face of the elastic bearings 5 and largely eliminate the elasticity thereof, so that the bristle bundles 3 can no longer deflect or cannot deflect to a significant extent. Thus, this position corresponds to the maximum bristle hardness.

Figure 4:
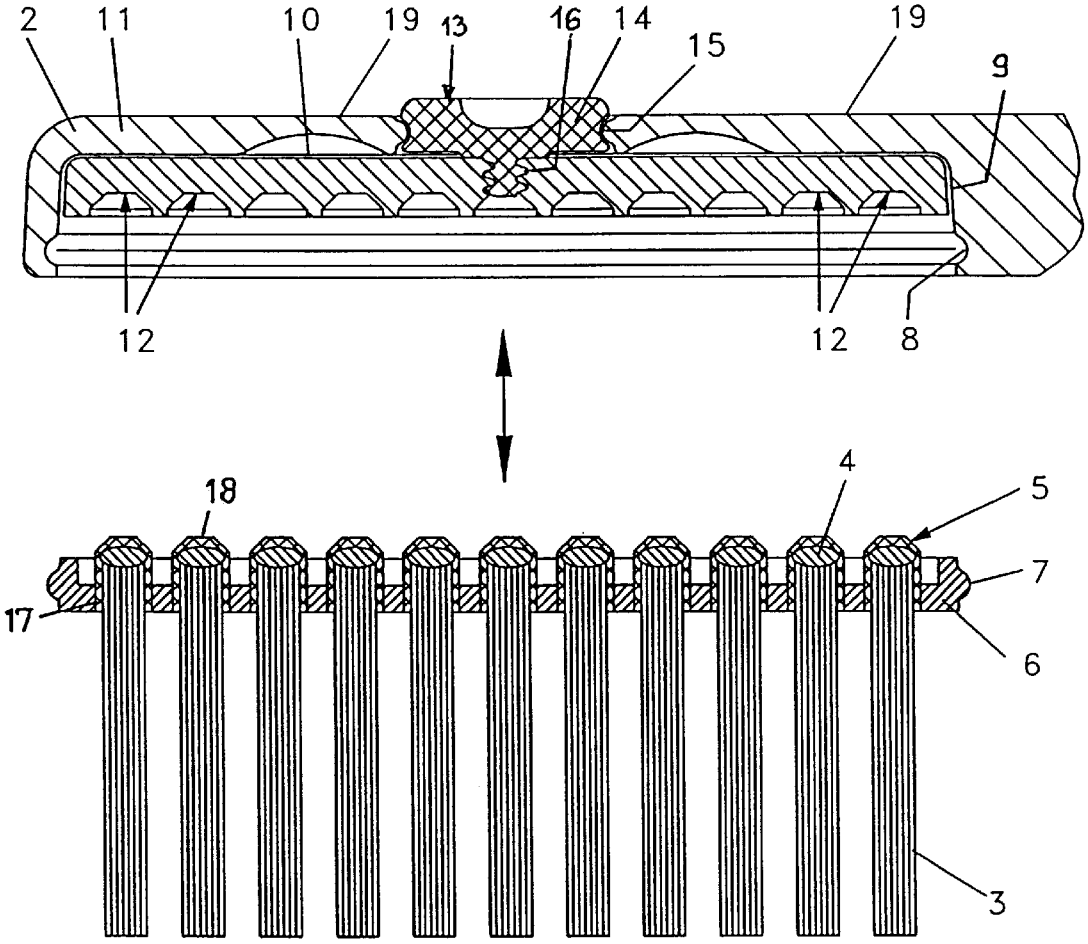
FIG. 4 A representation corresponding to FIG. 1 during the assembly of the brush.

As shown in FIG. 4, the perforated plate 6 with the elastic bearings 5 and bristle bundles 3 can be manufactured in a multicomponent injection moulding process, in that e.g. initially the bristle bundles 3 are melted to the thickening 4 at their fastening-side ends and located in holes of an injection mould, in which are successively produced the perforated plate 6 and the elastic bearings 5, accompanied by the injection moulding round of the thickenings 4. In the same way the bristle carrier 2, control plate 11 and knob 14 are produced in the injection moulding process and subsequently assembled, in that the perforated plate 6 with the circumferential rib 7 is placed in the bristle carrier, accompanied by locking in the channel 8. Assembly of the knob 14 in the bristle carrier 2 is facilitated in that the bristle carrier is weakened at 19 in the vicinity of the rotary bearing 15 and consequently has a spring action. These resilient areas 19 fulfil a further function, namely permitting the replacement of the perforated plate 6 with the bristle facing, in that by pressure on the knob 14, the areas 19 give way and by means of the control plate 11 the pressure is transferred to the elastic bearings 5 and perforated plate 6, so that the rib 7 is unlocked from the channel 8. The perforated plate 6 with the elastic bearings 5 and the bristle bundles can consequently be replaced by a new bristle facing following corresponding use.

Figure 5:
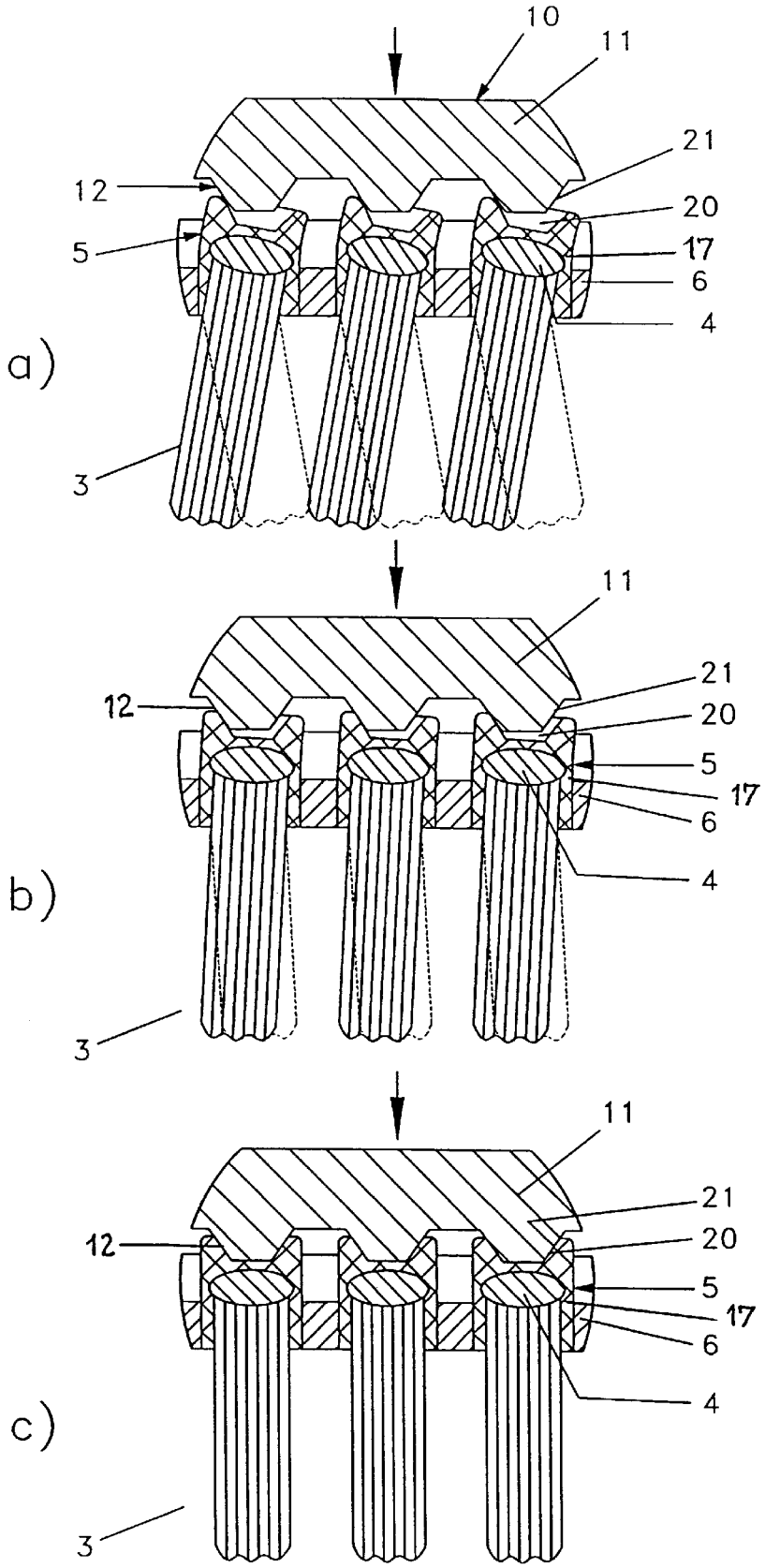
FIG. 5 A representation corresponding to FIG. 3 of another embodiment with three operating positions a), b) and c) of the control device.

In the embodiment according to FIG. 5, the elastic bearings 5 are provided on their inner faces with conical depressions 20. As rigid abutments 12, the control plate has corresponding conical projections 21 which, as a function of the infeed of the control plate 11, engage more or less deeply in the depressions 20 of the elastic bearings 5 and consequently limit the bearing elasticity to a greater or lesser extent, as indicated in positions a), b) and c).

Figure 6:
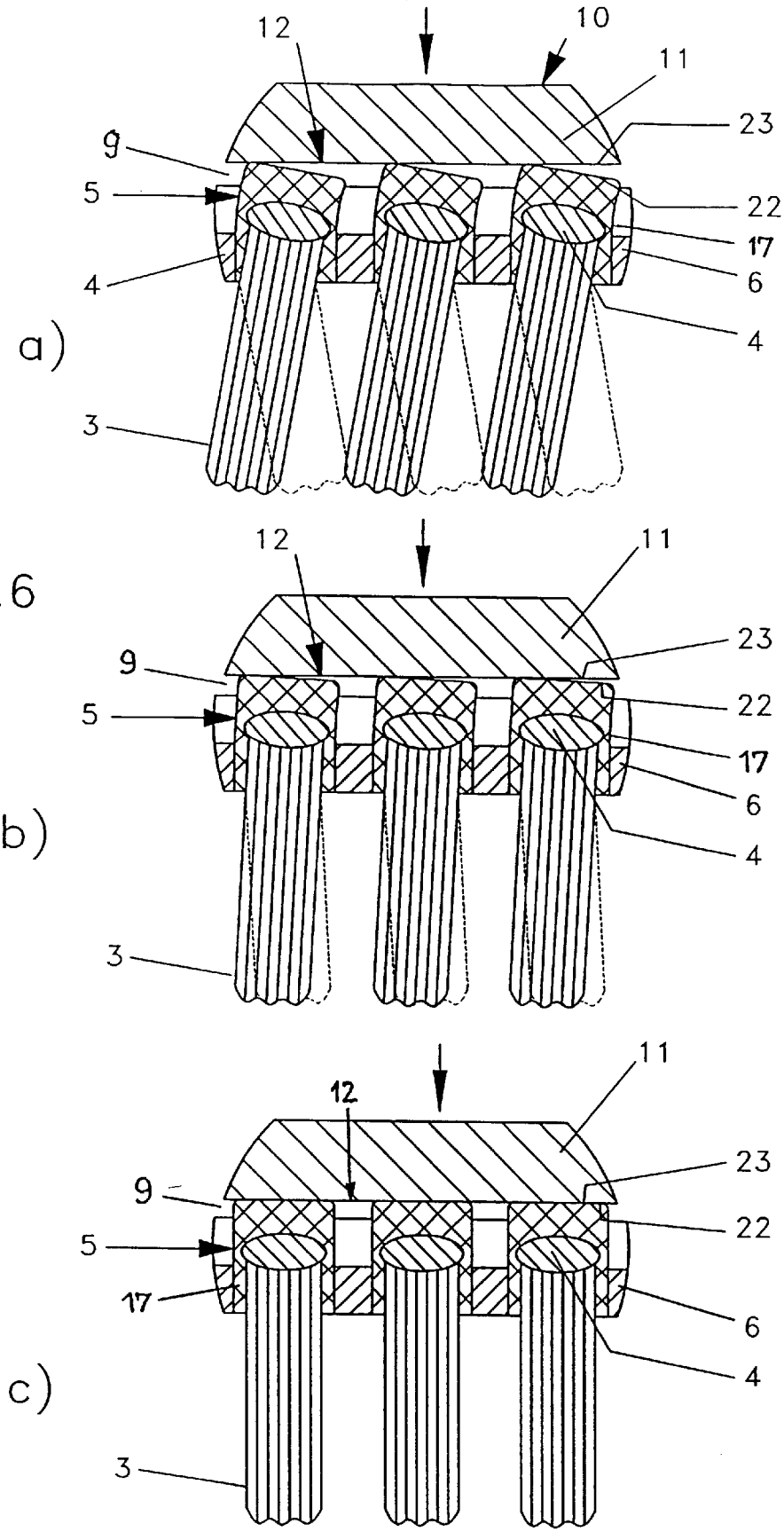
FIG. 6 Another embodiment with three operating positions a), b) and c).

In the embodiment according to FIG. 6, on their end located in the recess 9 of the bristle carrier 2, the elastic bearings 5 have a planar face 22. The control plate 11 has as the rigid bearing 12 a plane parallel to the perforated plate 6 with the bearing surface 23. When force is exerted on the bristle bundles 3 the elastic bearings 5 are deformed in such a way that the planar face 22 is tilted from the position parallel to the perforated plate 6. This tilting can be limited by the infeed of the control plate 6, as indicated in positions a), b) and c), so as in this way to vary the bristle hardness.

Figure 7:
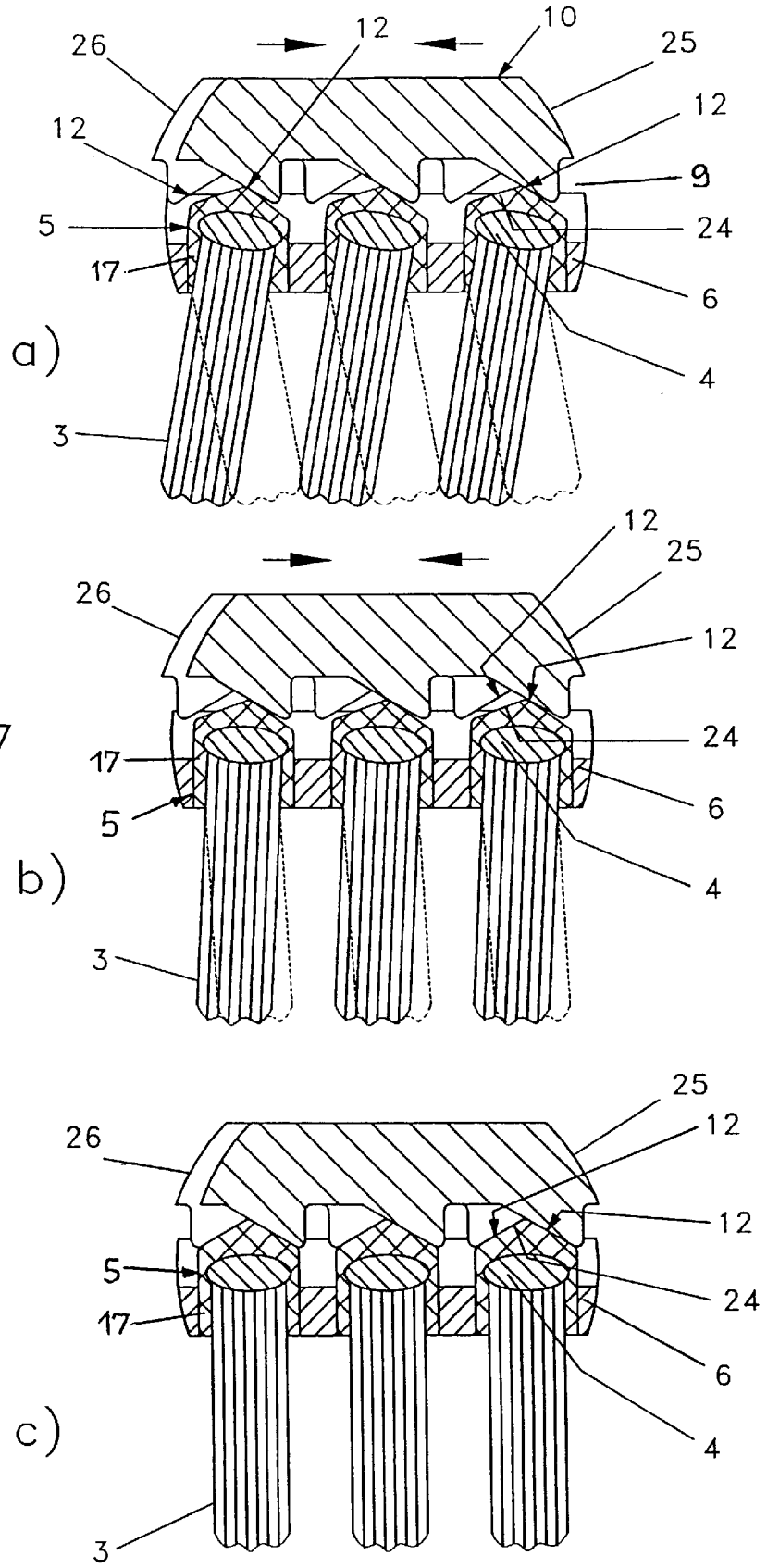
FIG. 7 A fourth embodiment with the operating positions a), b) and c).

In the embodiment of FIG. 7, the elastic bearings 5 have on their end located in the recess 9 of the bristle carrier 2 a conical face 24. The control device 10 comprises two opposing slides 25, 26, which in each case have half of a rigid bearing 12. These two halves are consequently displaceable against one another whilst reducing their spacing, as indicated by the arrows. By adjusting the two slides 25, 26 against one another, the freedom of movement of the conical faces 24 of the elastic bearings 5 from position a), via position b) into position c) is increasingly restricted. In position c), the two halves of the rigid bearing 12 engage on the conical face 24 of the elastic bearing 5.

What is claimed is:

1. Brushware comprising:

a bristle carrier, a plurality of bristles, elastic bearings movably mounting fastening side ends of said bristles on said bristle carrier to permit deflection of said ends of said bristles at least transversely with respect to a longitudinal axis of said bristles in the case of a force action thereon, and a control device for adjusting the permissible amount of said transverse deflection of said ends of said bristles.

2. Brushware according to claim 1, wherein said bristles are arranged in bundles which are movably mounted on said bristle carrier by way of respective ones of said elastic bearings.

3. Brushware according to claim 2, wherein at their fastening-side end the bristles of each bundle are melted to a thickening with which they are anchored in said elastic bearings.

4. Brushware according to claim 3, wherein said thickening of each bundle of the bristles is located in the area of its elastic bearing projecting over a perforated plate of said bristle carrier.

5. Brushware according to claim 3, wherein said thickening of each bundle of the bristles in its elastic bearing is level with the holes of a perforated plate of said bristle carrier.

6. Brushware according to claim 1, wherein said bristles are defectable transversely to said longitudinal axis thereof in all directions.

7. Brushware according to claim 1, wherein said bristles are mounted in elastically damped manner in the direction of their longitudinal axis by way of said elastic bearings.

8. Brushware according to claim 1, wherein said bristles are seated in said elastic bearings on the bristle carrier and are defectable accompanied by the deformation of the bearings.

9. Brushware according to claim 1, wherein said control device acts on said elastic bearings and is located on the bristle carrier.

10. Brushware according to claim 1, wherein said control device has means for limiting the deformation of the elastic bearings.

11. Brushware according to claims 1, wherein said control device has at least one rigid bearing associated with said elastic bearings and which is spaced from said elastic bearings and can be fed up to the latter by means of the control device.

12. Brushware according to claim 11, wherein said bristles with their elastic bearings are fixed in holes of a rigid perforated plate, whose front forms a use-side surface of the bristle carrier and wherein said fastening side ends of said bristles project over the perforated plate on the back thereof and wherein said control device with said at least one rigid bearing engages on the areas of the elastic bearings projecting over the perforated plate.

13. Brushware according to claim 12, wherein said control device has a control plate located in the bristle carrier substantially parallel to said perforated plate and which on its side facing the perforated plate has said at least one rigid bearing associated with said elastic bearings.

14. Brushware according to claim 13, wherein said control plate is guided in the bristle carrier and from a position in which the distance between said at least one rigid bearing and said elastic bearings is at a maximum can be fed up to the perforated plate, while reducing said distance.

15. Brushware according to claim 13, wherein said control plate is constructed as a slide, which is displaceably guided on said bristle carrier parallel to said perforated plate.

16. Brushware according to claim 13, wherein said control plate comprises two slides guided in opposition parallel to said perforated plate on the bristle carrier, said two slides each having facing portions of the rigid bearing with respect to the bearing axis.

17. Brushware according to claim 16, wherein said two slides are operable by means of tongues accessible on the bristle carrier.

18. Brushware according to claim 11, wherein said elastic bearings are formed from sleeves which have on their face facing the control device a depression, in which engages a projection of the control device forming said at least one rigid bearing.

19. Brushware according to claim 18, wherein said sleeves forming the elastic bearings are made from an elastomer and are manufactured with a perforated plate in a multicomponent injection moulding process, accompanied by the simultaneous embedding of said fastening-side ends of the bristles.

20. Brushware according to claim 11, wherein said at least one rigid bearing is formed from a planar abutment parallel to a perforated plate of said bristle carrier, and wherein said planar abutment cooperates with a terminal, planar face on each of said sleeves.

21. Brushware according to claim 12, wherein said elastic bearings are formed from sleeves which are circumferentially held in the holes of said perforated plate, said fastening-side ends of the bristles being anchored in said sleeves.

22. Brushware according to claim 12, wherein said at least one rigid bearing is constructed as a bearing bush on the control device and widens in the direction of the elastic bearings and corresponds with their terminal outer contour.

23. Brushware according to claim 1, wherein said bristle carrier includes a perforated plate with said elastic bearings and bristles fixed thereon, said perforated plate with elastic bearings and bristles being fixed in interchangeable manner to the bristle carrier.

24. Brushware according to claim 23, wherein said perforated plate is locked on the bristle carrier and can be ejected by means of said control device.

25. Brushware according to claim 1, wherein in the vicinity of the fastening side ends of said bristles the bristle carrier has a recess in which is guided said control device and which recess is closed by a perforated plate.

26. Brushware according to claim 1, wherein said control device has a screw cooperating with a control plate of said control device, which control plate is mounted on said bristle carrier and provided with a knob accessible at the back of the bristle carrier.

27. Brushware according to claim 26, wherein in the vicinity of a rotary bearing for said knob, the bristle carrier is resiliently constructed so as to be deformable by pressure on the knob for ejecting the perforated plate.

28. Brushware according to claim 1, further comprising bristles of the entire bristle facing of said brushware which are directly injected into a perforated plate of said bristle carrier so as to be anchored therein without use of said elastic bearings.

* * * * *